US009960505B2

(12) United States Patent
Spey

(10) Patent No.: US 9,960,505 B2
(45) Date of Patent: May 1, 2018

(54) TERMINAL STRIP

(71) Applicant: WAGO Verwaltungsgesellschaft mbH, Minden (DE)

(72) Inventor: Gunter Spey, Heuerssen (DE)

(73) Assignee: WAGO Vervaltungsgesellschaft mbH, Minden (DE)

( * ) Notice: Subject to any disclaimer, the term of this patent is extended or adjusted under 35 U.S.C. 154(b) by 0 days. days.

(21) Appl. No.: 15/445,281

(22) Filed: Feb. 28, 2017

(65) Prior Publication Data

US 2017/0250478 A1 Aug. 31, 2017

(30) Foreign Application Priority Data

Feb. 29, 2016 (DE) ..... 20 2016 101 051 U

(51) Int. Cl.
*H01R 9/26* (2006.01)
*H01R 25/16* (2006.01)
*H01R 12/71* (2011.01)

(52) U.S. Cl.
CPC ..... *H01R 9/2608* (2013.01); *H01R 9/2675* (2013.01); *H01R 12/71* (2013.01); *H01R 25/165* (2013.01)

(58) Field of Classification Search
CPC ..... H01R 9/2608; H01R 9/2675; H01R 12/71
USPC ..... 439/722
See application file for complete search history.

(56) References Cited

U.S. PATENT DOCUMENTS 6,506,071 B2 * 1/2003 Lange ..... H01R 9/26 439/358
7,192,316 B1 * 3/2007 Pollmann ..... H01R 9/2675 439/716
7,666,037 B2 * 2/2010 Diessel ..... H01R 9/2616 439/716
7,690,952 B2 * 4/2010 Koellmann ..... H01R 9/26 439/716
8,581,131 B2 * 11/2013 Pollmann ..... H01H 1/365 200/244
9,407,019 B2 * 8/2016 Falk ..... H01R 9/2608
(Continued)

FOREIGN PATENT DOCUMENTS

DE 196 30 860 C1 10/1997
DE 199 02 745 A1 8/2000
(Continued)

*Primary Examiner* — Alexander Gilman
(74) *Attorney, Agent, or Firm* — Muncy, Geissler, Olds & Lowe, P.C.

(57) ABSTRACT

A terminal strip having an insulating material housing that has a latching foot for latching onto a mounting rail and has a width less than the length and height, and conductor connections in the insulating material housing that are arranged next to one another in pairs. The insulating material housing is in two parts and has a base housing and a lower housing. The base housing has, in a first connection region, a pair of conductor connections that are electrically conductively connected to one another. In a second connection region, the base housing has a cutout that is laterally bounded by the insulating material of the second connection region. The lower housing can be inserted into the cutout. The lower housing has a conductor connection that is electrically insulated from an adjacent conductor connection that is arranged in the second connection region, in the base housing.

12 Claims, 10 Drawing Sheets

(56) References Cited

U.S. PATENT DOCUMENTS

| | | | | |
|---|---|---|---|---|
| 9,667,005 | B2 * | 5/2017 | Pizzi | H01R 25/142 |
| 2001/0034165 | A1 * | 10/2001 | Landis | H01R 13/6658<br>439/716 |
| 2004/0248464 | A1 * | 12/2004 | Xue | H01R 12/716<br>439/541.5 |
| 2011/0014808 | A1 * | 1/2011 | Diessel | H01R 9/2675<br>439/296 |
| 2015/0147907 | A1 * | 5/2015 | Goerlitzer | H01R 9/2625<br>439/512 |
| 2016/0233593 | A1 * | 8/2016 | Pizzi | H01R 9/26 |

FOREIGN PATENT DOCUMENTS

| | | | |
|---|---|---|---|
| DE | 100 45 498 | A1 | 3/2002 |
| DE | 10 2006 052 894 | A1 | 5/2008 |
| DE | 10 2007 059 640 | B4 | 11/2009 |
| WO | WO 03/077370 | A1 | 9/2003 |

* cited by examiner

TERMINAL STRIP

This nonprovisional application claims priority under 35 U.S.C. § 119(a) to German Patent Application No. 20 2016 101 051.9, which was filed in Germany on Feb. 29, 2016, and which is herein incorporated by reference.

BACKGROUND OF THE INVENTION

Field of the Invention

The invention relates to a terminal strip comprising an insulating material housing, which has a latching foot for latching onto a mounting rail and has a width which is less than the length and height, and comprising conductor connections in the insulating material housing which are arranged next to one another in pairs in the direction of the width.

Description of the Background Art

DE 10 2007 059 640 B4, which corresponds to U.S. Pat. No. 7,690,952, and which is incorporated herein by reference, discloses a connection module for electrical conductors comprising a spring-force clamping connection, in which connection module two conductor connections are arranged next to one another on a common busbar. A plurality of conductor connection pairs of this kind are arranged one above the other in the direction of the height of the connection module and one behind the other in the direction of the length of the connection module in a manner electrically isolated from one another in different potential levels. The individual busbar pieces have connection openings for receiving bent-away ends of busbar rods which are led into channels of the insulating material housing to further conductor connection terminals.

DE 196 30 860 C1 discloses an initiator/actuator terminal strip comprising a base part on which connecting contact parts are arranged. Individual distributor elements are provided which can be plug-mounted onto a connecting contact part of the terminal strip as individual conductor connection plugs with a separate insulating material housing.

DE 10 2006 052 894 A1, which corresponds to U.S. Pat. No. 7,666,037, discloses a terminal strip with a plug-mountable test plug which has separate conductor connections and various bridge shafts and can be electrically conductively connected to the current path of the terminal strip.

SUMMARY OF THE INVENTION

It is therefore an object of the present invention to provide an improved terminal strip in which conductor connections are arranged next to one another in pairs, wherein conductor connections of a conductor connection pair are electrically conductively connected to one another in a first connection region and conductor connections which are arranged next to one another are electrically isolated from one another in a second connection region.

In an exemplary embodiment, the insulating material housing of the terminal strip is formed in two parts and has a base housing and a lower housing. The base housing has, in a first connection region, a pair of conductor connections which are electrically conductively connected to one another and, in a second connection region, a cutout in the direction of the width, which cutout is laterally bounded by the insulating material of the second connection region. The lower housing can be inserted into the cutout. The lower housing has a conductor connection which is electrically insulated from an adjacent conductor connection, which is arranged in the second connection region, in the base housing.

The terminal strip therefore can have at least two rows of conductor connections which are arranged in the modular mounting direction of the terminal strip on the mounting rail, that is to say seen in the direction of the width. With the aid of the two-part embodiment of the insulating material housing, which has a cutout in the second connection region and a separate lower housing which can be permanently or detachably installed in the cutout after installation of the conductor connection in the second connection region of the base housing and after electrically conductive connection of said conductor connection to conductor connections of the first connection region, it is possible to connect the conductor connections, which are arranged next to one another, in the second connection region to different potential levels of the first connection region. Whereas a conductor connection pair, which are arranged next to one another, in the first connection region are electrically conductively connected to one another and therefore are at the same potential, the conductor connections, which are arranged next to one another, of the conductor connection pair of the second connection region, that is to say the conductor connections in the base housing and the lower housing, are electrically isolated from one another. The current paths, which are situated next to one another, in the second connection region are therefore isolated from one another differently to the current paths, which are situated next to one another, of a conductor connection pair or a potential level in the first connection region. The second connection region can therefore be used as a signal level.

Owing to the two-part embodiment of the insulating material housing and the cutout in the base housing, the terminal strip can be easily manufactured and can be of compact construction. In addition, it is ensured that the required air gaps and leakage paths are readily complied with in the case of a compact construction.

The first connection region can have a plurality of pairs of conductor connections. The conductor connections, which are arranged next to one another, of the second connection region can then be connected to conductor connections of different conductor connection pairs, which are not electrically connected to one another, of the first connection region. This connection can be made either directly by means of electrical conductors as the electrical connection or indirectly by means of an interposed electronics system.

The lower housing can be permanently installed in the cutout or can latch into the cutout as a separate lower housing. Therefore, it is advantageous when the separate lower housing is in the form of a separate terminal strip comprising a busbar which has at least one conductor connection. In this case, the conductor connections of the lower housing are arranged in a row on a connection level and are supplemented by the conductor connections of the second connection region of the base housing to form a group of conductor connections, which are arranged in two rows next to one another, for the second connection level in which the conductor connections of the group are electrically and functionally isolated from one another.

The lower housing can have a bridge shaft which leads to a bridge opening in the busbar. This bridge shaft can be used, in a manner which is known per se, for receiving a transverse bridge. However, the bridge shaft can also be used in order to introduce a light guide element into the bridge shaft, wherein the light guide enters the bridge opening and may protrude through said bridge opening in order to form an optically conducting connection with an optical element of the base housing. Therefore, optical signals can also be transmitted from the base housing to the outside of the lower housing. However, the bridge shaft and the light guide element can also be used for unidirectional or bidirectional optical signal transmission.

Conductor connection pairs, which are electrically isolated from one another, of the first connection level can each be connected to conductor connections, which are arranged next to one another in the second connection level in the base housing and in the lower housing, of a group of conductor connections, which are electrically insulated from one another, by means of electrical conductors and/or by means of an electronics system which is accommodated in the insulating material housing.

Conductor connection pairs of the first connection level can be arranged in potential levels which are situated one above the other in the direction of the height of the terminal strip and one behind the other in the direction of the length of the terminal strip. These potential levels are therefore offset in relation to one another in terms of height and length. The conductor connections of a group of conductor connections, which are arranged next to one another, of the second connection level can then be electrically conductively or electronically connected to the conductor connection pairs of different potential levels. This is done in a simple and reliable manner by using the separate lower housing which is installed in the cutout of the base housing.

The conductor connections of a conductor connection pair of the first connection level can be arranged next to one another on a common busbar. In this case, the busbar can have a connection point for terminal connection of an electrical conductor which is routed to a conductor connection of the second connection region or for connection of a printed circuit board which is accommodated in the base housing. The connection point of the busbar can therefore be in the form of a clamping connection, in the form of a solder connection or the like. Therefore, electrically conductive connection of the conductor connections of the first and the second connection level can be realized in a simple and flexible manner.

The busbar can have a bridge opening for terminal connection of a transverse bridge, and the base housing can have a bridge shaft which leads to the bridge opening. Therefore, the potential levels of terminal strips which are arranged next to one another can be electrically conductively connected to one another by means of transverse bridges. However, it is also conceivable for the bridge opening to be used as a clamping point for terminal connection of an electrical conductor (for example a busbar rod) which is led to the second connection level.

The conductor connections can be in the form of spring-force clamping connections, in the form of screw-type clamping connections, in the form of insulation-displacement clamping connections or the like. A very reliable conductor connection which is stable over the long-term and is independent of weather conditions can be realized, in particular, with spring-force clamping connections, possibly in connection with the associated operating openings in the insulating material housing.

The lower housing can have a different color in relation to the base housing. With the aid of a separate lower housing, it is therefore possible to optically separate the different signal levels which are arranged next to one another in the second connection region in a surprisingly simple manner. This is achieved, once again, by the use of a separate lower housing which is inserted into the recess in the base housing.

The side wall of the base housing which is situated opposite the cutout can be closed. The conductor connections are then inserted into the base housing from the side which is provided with the cutout. This ensures that the required air gaps and leakage paths are reliably maintained in the case of terminal strips which are lined up next to one another on a mounting rail, without the overall width of a terminal strip arrangement of this kind being significantly increased.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
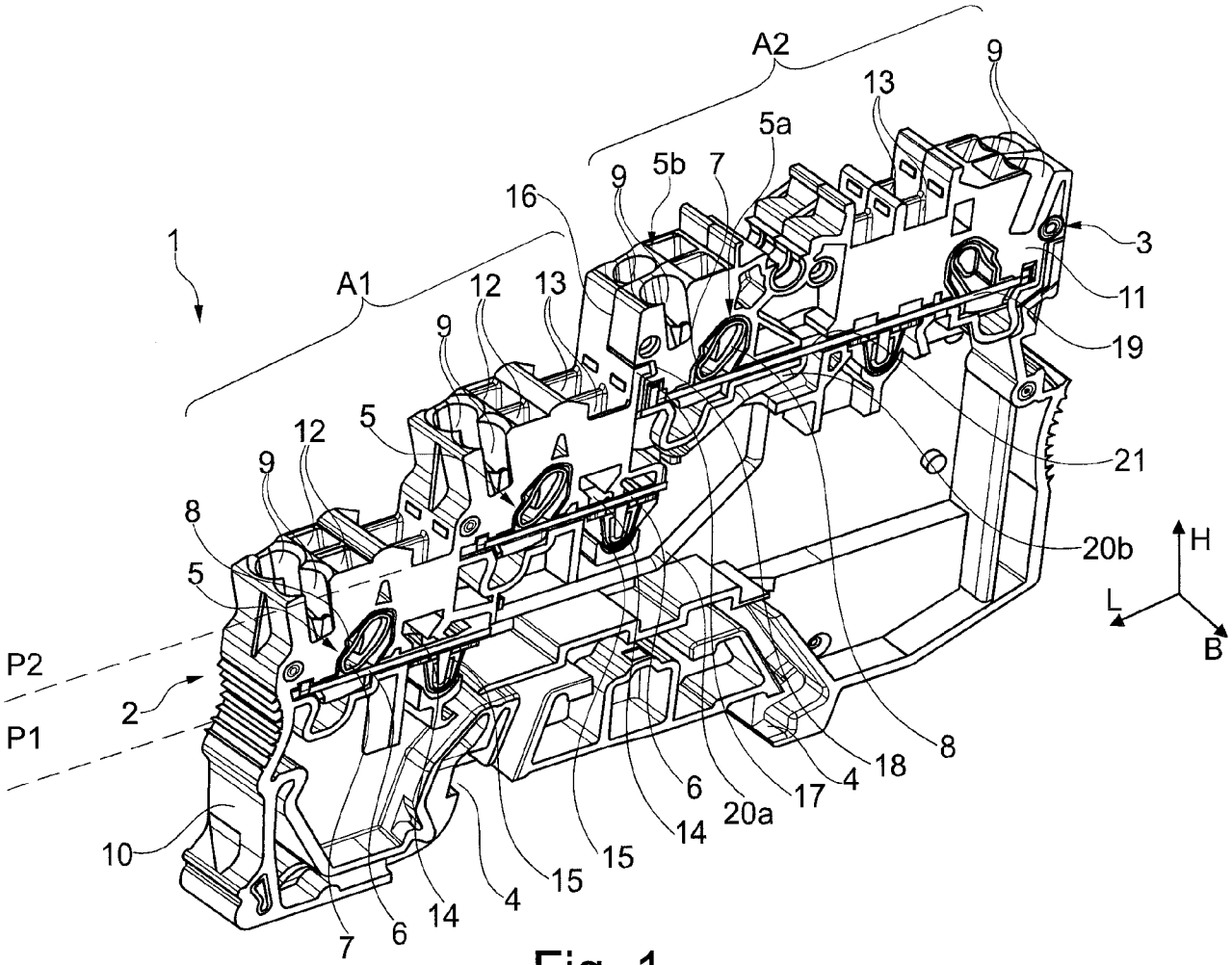
FIG. 1 shows a perspective view of a terminal strip comprising a base housing and a lower housing.

FIG. 1 shows a perspective view of a terminal strip 1 which has a base housing 2 and a lower housing 3. The base housing 2 has, in the lower region, a latching foot 4 for latching onto a mounting rail (not illustrated).

Two rows of conductor connections 5 are provided next to one another in pairs in the base housing 2. In this case, a busbar 6, which in each case has a conductor passage opening 7 and a leg spring 8 which is suspended in the conductor passage opening 7, is provided on a potential level in each case. However, it is also conceivable for another type of conductor clamping connection 5, for example with a cage tension spring, a screw-type terminal, an insulation-displacement connection or the like to be realized.

A conductor insertion channel 9, which is inserted into the insulating material housing 10 of the base housing 2 or into the insulating material housing 11 of the lower housing 3, respectively leads to a conductor connection 5. An operating shaft 12, which leads to a clamping spring 8 and is designed for insertion of an operating tool and for opening a clamping point, which is formed by the clamping spring 8 and the busbar 6, for an electrical conductor, is respectively provided adjacent to a conductor insertion channel 9.

Bridge shafts 13 which each lead to a bridge opening 14 of the busbars 6 and are provided for terminal connection of a transverse bridge to busbars 6 of terminal strips 1 which are arranged next to one another, are further provided. Clamping springs 15 which are bent in the shape of a U are optionally suspended in the bridge openings 14 in the busbars 6.

In a first connection region A1, the terminal strip 1 has conductor connections 5, which are in each case arranged next to one another in pairs and are electrically conductively connected to one another, in two potential levels P1, P2 as seen in the direction of the height H of the terminal strip 1. As seen in the direction of the length L, a second connection region A2, in which two rows of conductor connections 5*a*, 5*b* are in turn arranged next to one another in the direction of the width B, is provided next to the first connection region A1. A pair of conductor connections 5*a*, 5*b* which are arranged next to one another are not electrically conductively connected to one another in this second connection region A2, as in the first connection region A1, but rather are electrically insulated from one another.

Since the rear side wall, not visible, of the terminal strip 1 is closed, a busbar 6 can be inserted into the terminal strip only from the illustrated open side of said terminal strip.

In the second connection region A2, electrical isolation is achieved by the base housing 2 having a cutout 16. This cutout 16 is laterally bounded by the insulating material housing 10 of the base housing 2 in the direction of the width or is bounded by the interior of the base housing 2 in the direction of the latching foot 4. At its end, the insulating material housing 10 of the base housing 2 has a latching lug 17 which protrudes into the cutout 16 and is designed to latch in a latching recess 18 in the lower housing 3.

A single-row busbar 19 is respectively installed both in the base housing 2 and in the lower housing 3 in the region of the second connection region A2, conductor connections 5*a*, 5*b* in turn being formed on said busbar in the manner described above. The conductor connections 5*a*, 5*b*, which are situated next to one another, in the second connection region A2 are not electrically conductively connected to one another with the aid of the two separate busbars 19, which are situated next to one another, in the base housing 2 and the lower housing 3. Since the lower housing 3 has a closed side wall in relation to the cutout 16, electrical insulation while maintaining the required air gaps and leakage paths is also ensured.

Therefore, the conductor connections 5*a*, 5*b* in the two rows, which are situated next to one another, of the second connection region A2 are electrically insulated from one another, while the pairs of conductor connections 5 in the first connection region A1 are each electrically conductively connected to one another in the potential levels P1 and P2.

With the aid of electrical conductors 20, which can be designed, for example, as busbar rods or as rigid or flexible conductors, a potential level P1, P2 is now respectively connected either to the conductor connections 5*b* of the base housing 2 in the second connection region A2 or to the conductor connections 5*a* of the lower housing 3 in the second connection region A2. It can be seen that an electrical conductor 20*a* is connected to the busbar 6 in the first potential level P1 and to the busbar, not visible, in the second connection region A2 of the base housing 2.

However, a second electrical conductor 20*b* is routed from the busbar 6 in the second potential level P2 to the busbar 19 of the lower housing 3 in the second connection region A2. It is clear that these electrical conductors each enter a clamping opening 21 in the busbar 19 and are electrically conductively connected there. This can be performed, for example, by means of clamping, calking, soldering, welding or the like. However, it is also feasible to form a spring-force plug contact for connecting an electrical conductor 20*a*, 20*b* to a busbar 6, 19.

Figure 2:
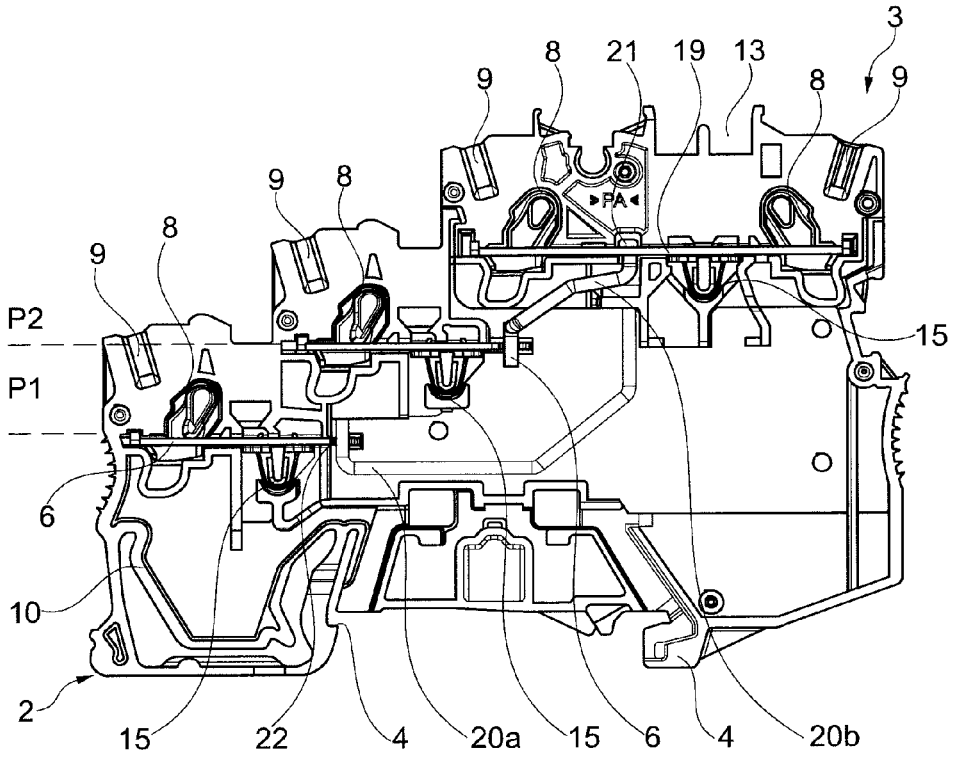
FIG. 2 shows a side view of the terminal strip from FIG. 1.

FIG. 2 shows a side view of the terminal strip 1 from FIG. 1. Here, it is even more clear that the electrical conductors 20*a*, 20*b* are clamped into clamping slots 22 in the busbars 6. A simple electrically conductive connection is achieved in a simple manner in this way.

Figure 3:
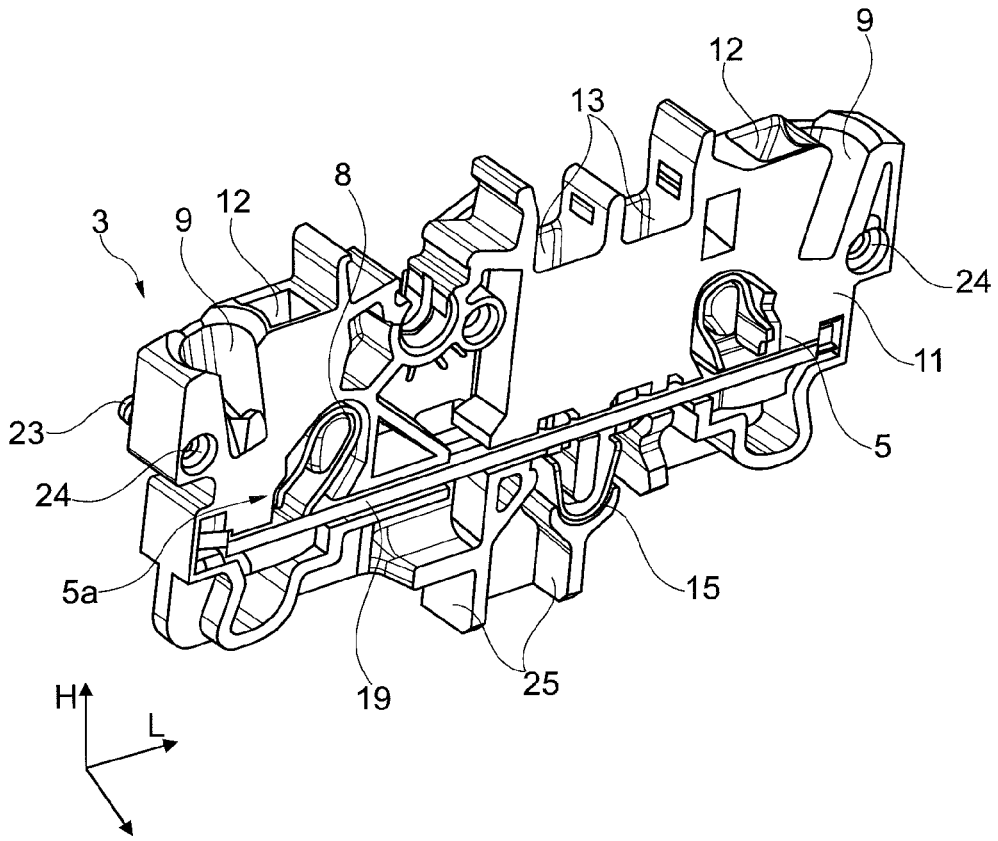
FIG. 3 shows a perspective view of the lower housing for the terminal strip from FIGS. 1 and 2.

FIG. 3 shows a perspective view of the lower housing 3 which is formed from an insulating material housing 11 in the form of a terminal strip. A busbar 19 is inserted into the insulating material housing 11 in order to realize a pair of conductor connections 5*a* in one row. It can be seen, for example in the region of the conductor insertion opening 9, that the rear side of the insulating material housing 11 is closed. A latching pin 23, which is provided for latching into a corresponding latching opening in the base housing 2 in the second connection region A2, protrudes from the rear side at the two opposite ends. A corresponding latching opening 24 is respectively provided in the lower housing 3 opposite a latching pin 23.

It can be seen that the single-row terminal strip which forms the lower housing 3 has, in each case arranged one behind the other as seen in the direction of the length L, conductor insertion channels 9, operating shafts 12 and bridge shafts 13. It is clear that the lower housing 3 has a plug contour on the lower side with guide/holding walls 25 which are inserted into the interior of the base housing 2 and there form a guide for aligning the lower housing 3 with the base housing 2.

When the lower housing 3 is inserted into the base housing 2 as in FIG. 1, it is inserted into the cutout 16 in the base housing 2 such that it fits, and is latched there.

Figure 4:
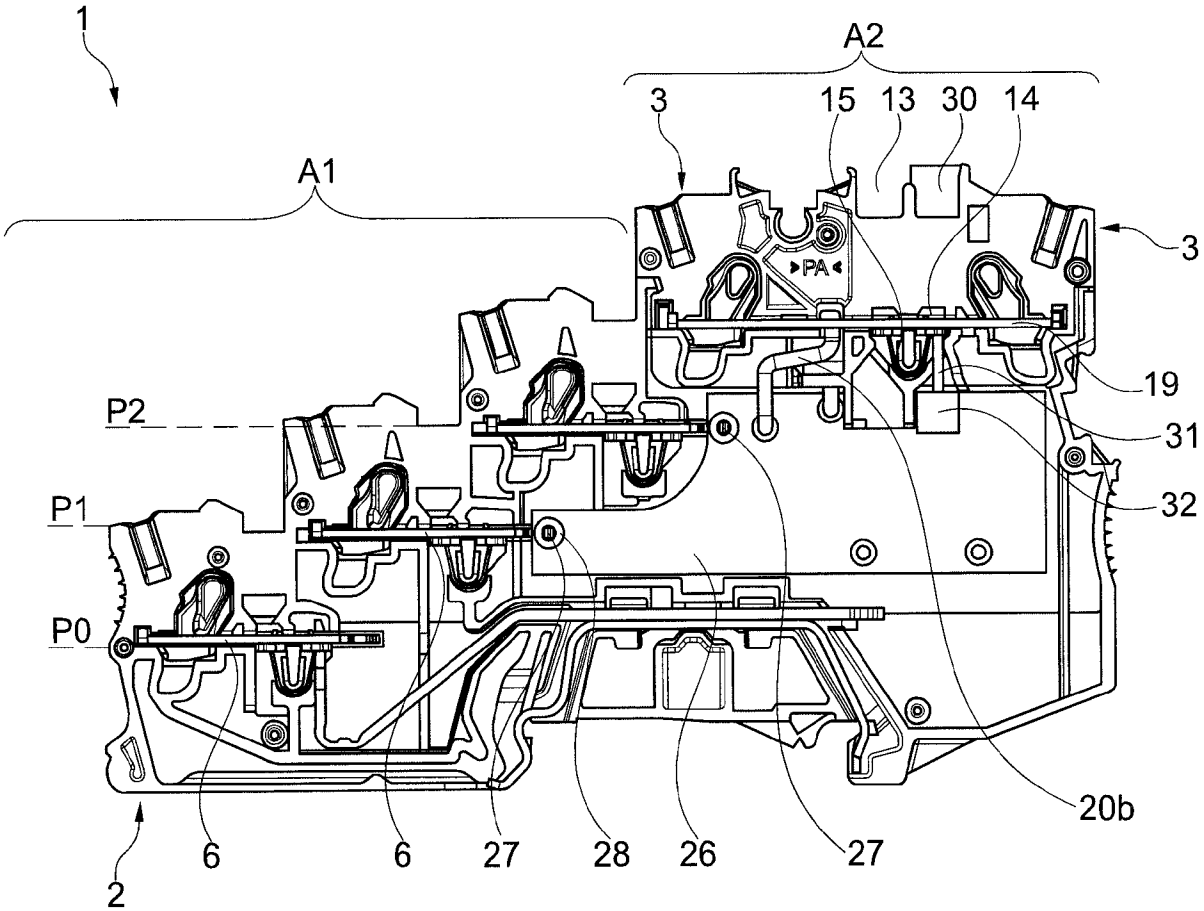
FIG. 4 shows a side view of an embodiment of the terminal strip comprising an installed printed circuit board.

FIG. 4 shows a side view of an embodiment of the terminal strip 1 in which a printed circuit board 26 is accommodated in the interior of the base housing 2. In this case, the busbars 6 are electrically conductively connected to the printed circuit board 26 with the aid of contact pins 27 in two potential levels P1, P2. In this case, the contact pins 27 are inserted into bores 28 in the printed circuit board 26 and there soldered, for example, to the printed circuit board 26. Therefore, the two potential levels P1 and P2 are each, separately from one another, electrically conductively connected to the printed circuit board 26 and an electronics system which is fitted on said printed circuit board. The busbars 19 in the second connection level A2 are likewise connected to the printed circuit board 26 and an electronics system which is arranged on said printed circuit board by means of electrical conductors 20*a* (not visible) and 20*b*. In this way, the second connection level A2 can be used for a signal level, wherein the signals of busbars 19 which are arranged next to one another, that is to say the signals in the second connection level A2 on the lower housing 3 and on the base housing 2, differ from one another.

Furthermore, it can be seen that a light guide 28 is inserted into a bridge shaft 13 of the base housing 2. Said light guide protrudes, by way of its free end, through the bridge opening 14 in the busbar 19 and is locked to the busbar 19 by the clamping spring 15. The light inlet end 30 of the light guide 28 lies on a light 31 which is soldered to the printed circuit board 26. Therefore, optical signals can be emitted through the light 31 and can be optically transmitted to the top side of the terminal strip 1 by means of the light guide 28. Therefore, separate light signals are possible for the signal path in the base housing 2 and for the signal path in the lower housing 3.

Figure 5:
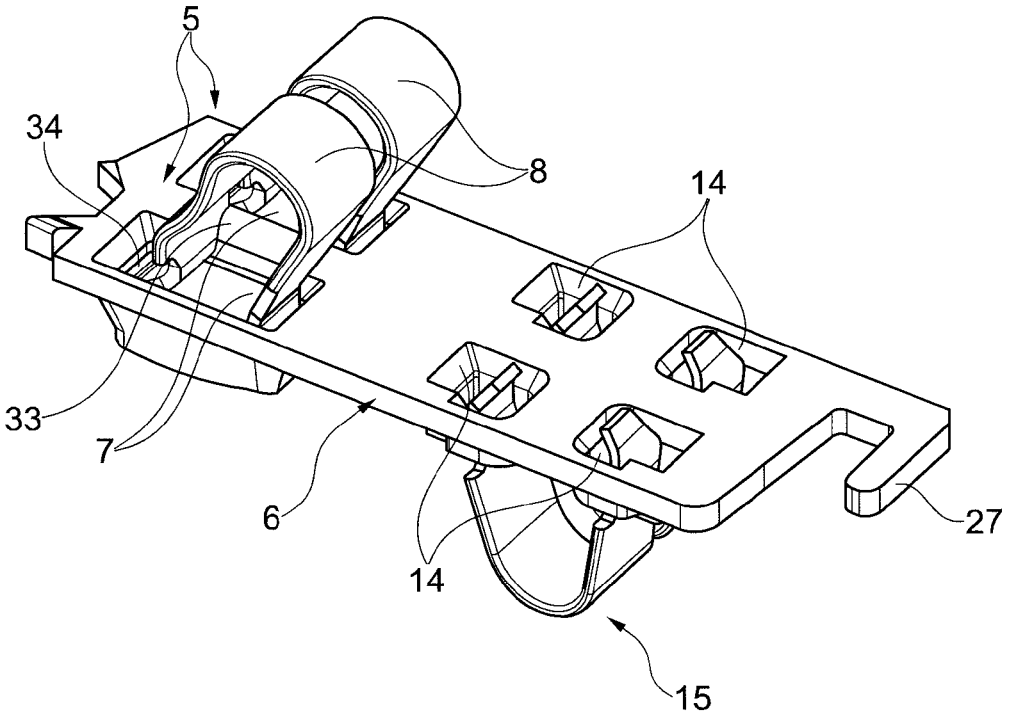
FIG. 5 shows a perspective view of a busbar for the terminal strip from FIG. 1.

FIG. 5 shows a perspective view of the busbar 6 for the first connection level A1. It is clear that two clamping springs 8 in the form of a U-shape are each suspended in a conductor passage opening 7 in the busbar 6. The conductor passage openings 7, which are arranged next to one another, are separated from one another by an intermediate web 32. The free end of a clamping spring 8 forms, together with a clamping edge 33 of the busbar 6 which bounds the conductor passage opening 7, a clamping point for terminal connection of an electrical conductor.

It is further clear that two bridge openings 14 are arranged one behind the other in the longitudinal direction of the busbar 6 in each case. A further pair of bridge openings 14 of this kind is arranged next to said two bridge openings in the direction of the width of the busbar 6. A pair of bridge openings 14, which are arranged one behind the other, respectively accommodates a free end of a U-shaped clamping spring 15 in order to therefore terminally connect either a transverse bridge or a light guide 28.

It can be seen that a contact pin 27 is formed on the busbar on the side which is situated opposite the conductor clamping connections 5. Said contact pin can be used for soldering into a printed circuit board 26.

However, it is also conceivable that a clamping slot for terminal connection of an electrical conductor, for example in the form of a busbar rod, is provided there.

Figure 6:
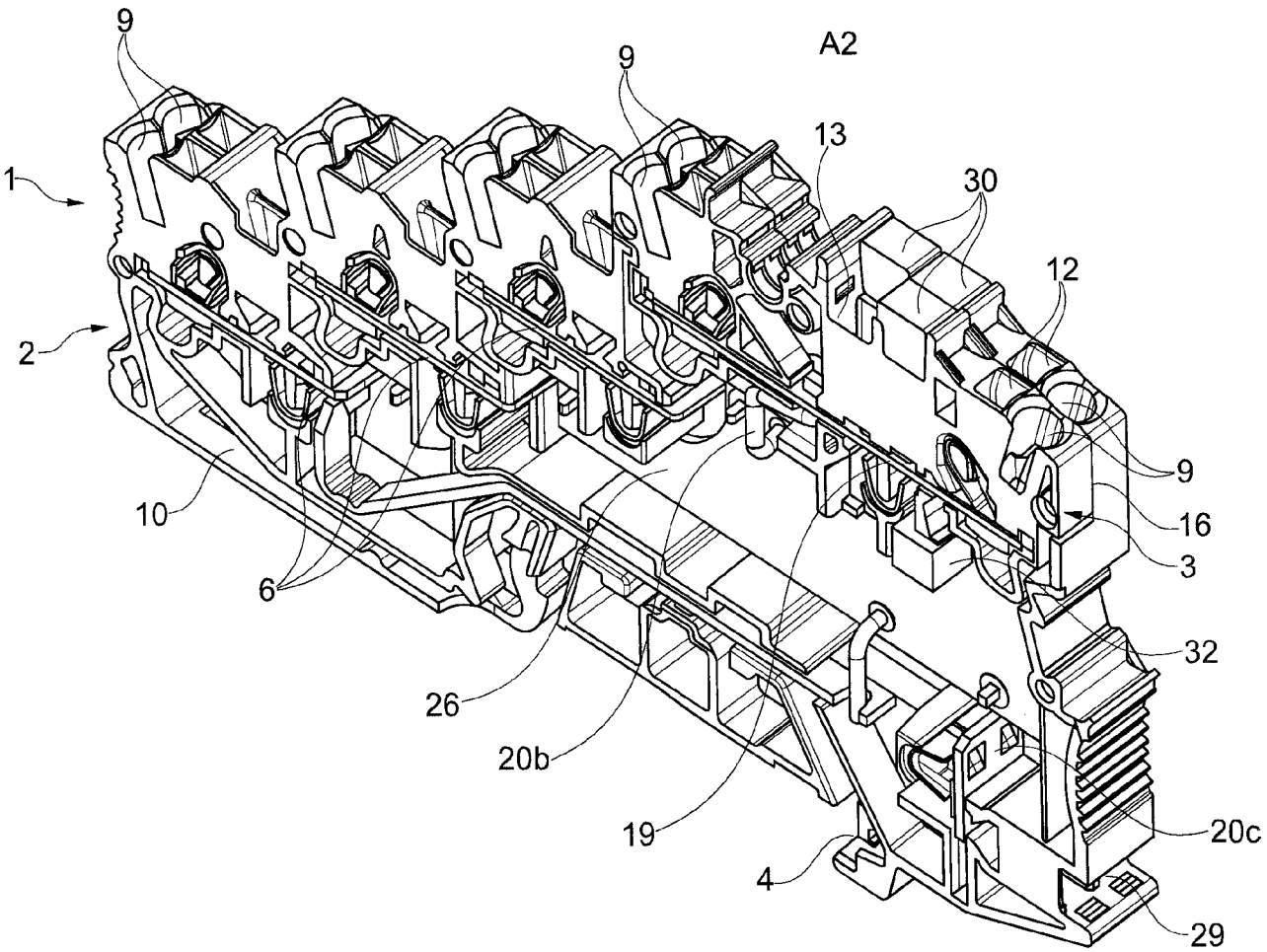
FIG. 6 shows a perspective view of a terminal strip with light guides inserted.

FIG. 6 shows a perspective view of a terminal strip 1 comprising a two-row base housing 2 and the lower housing 3 which is inserted into the cutout 16. In this embodiment, three light guides 28 are now inserted into associated bridge shafts 13 and latched there. It can be seen here that the base housing 2 is functionally separated from the lower housing 3 in the second connection region A2, but the lower housing 3 is inserted into the contour of the base housing 2. With the aid of the separate lower housing 3, it is possible to first insert (not visible) a busbar 19 into the base housing 2 in the second connection region A2 and then to close the cutout 16 with the aid of the separate lower housing 3 which, in the manner of a terminal strip, has its own, functionally independent busbar 19.

Figure 7:
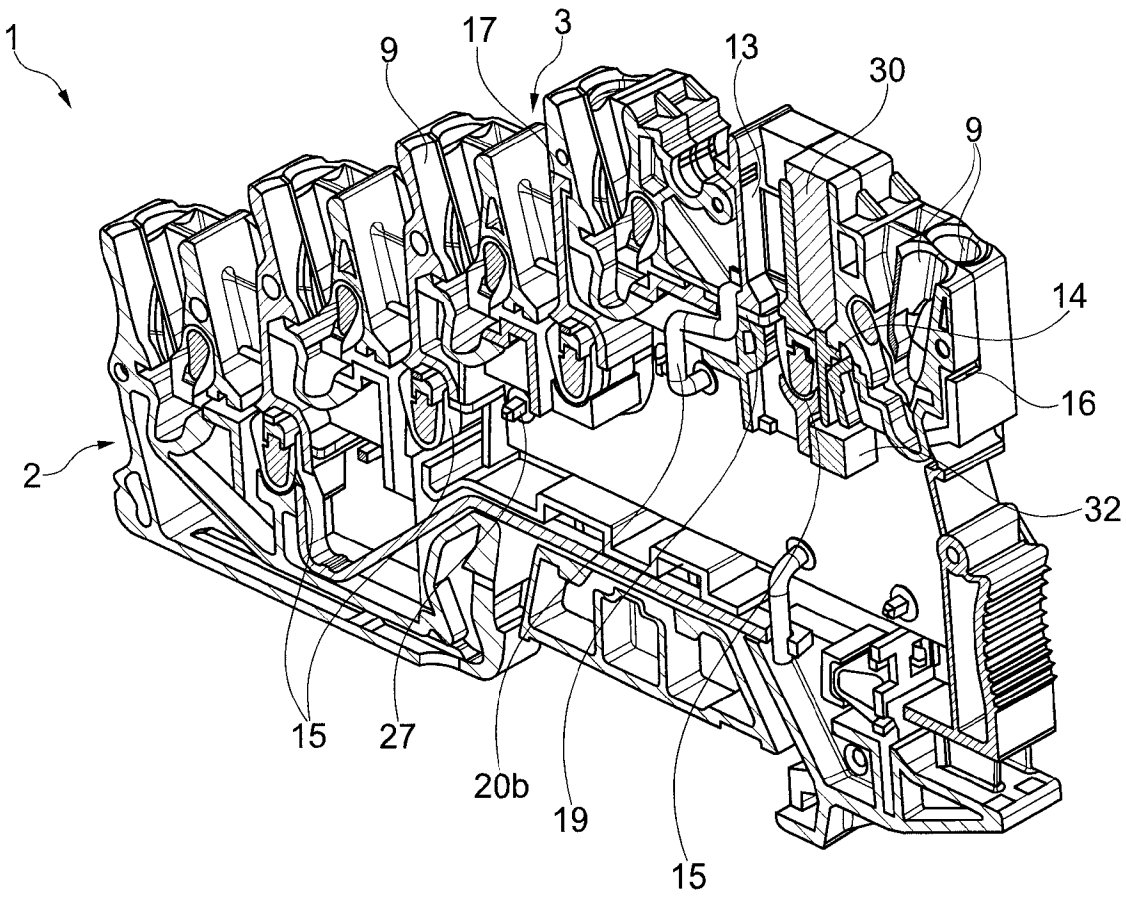
FIG. 7 shows a perspective view of a longitudinal section through the terminal strip from FIG. 6.

FIG. 7 shows a view of a longitudinal section through the terminal strip 1 from FIG. 6. It is clear here that the light guides 30 extend through a bridge shaft 13 and through a bridge opening 14 in the busbar 19 in order to in this way adjoin a light element 30 by way of the light inlet side.

A rear bridge shaft 29, in which a transverse bridge can be led to a bridge clamping contact on a flat electrical conductor 20*c*, is provided at the level somewhat above the latching foot 4 on the narrow side of the base housing 2. The flat electrical conductor 20*c* is configured in the manner of a busbar piece and soldered to a contact pin on the printed circuit board 26. A leg spring which is bent in the shape of a U can be suspended in a bridge opening in the flat electrical conductor 20*c*.

It can also be seen that the lower housing 3 merges with the contour of the cutout 16 and there rests in suitable mounts.

Figure 8:
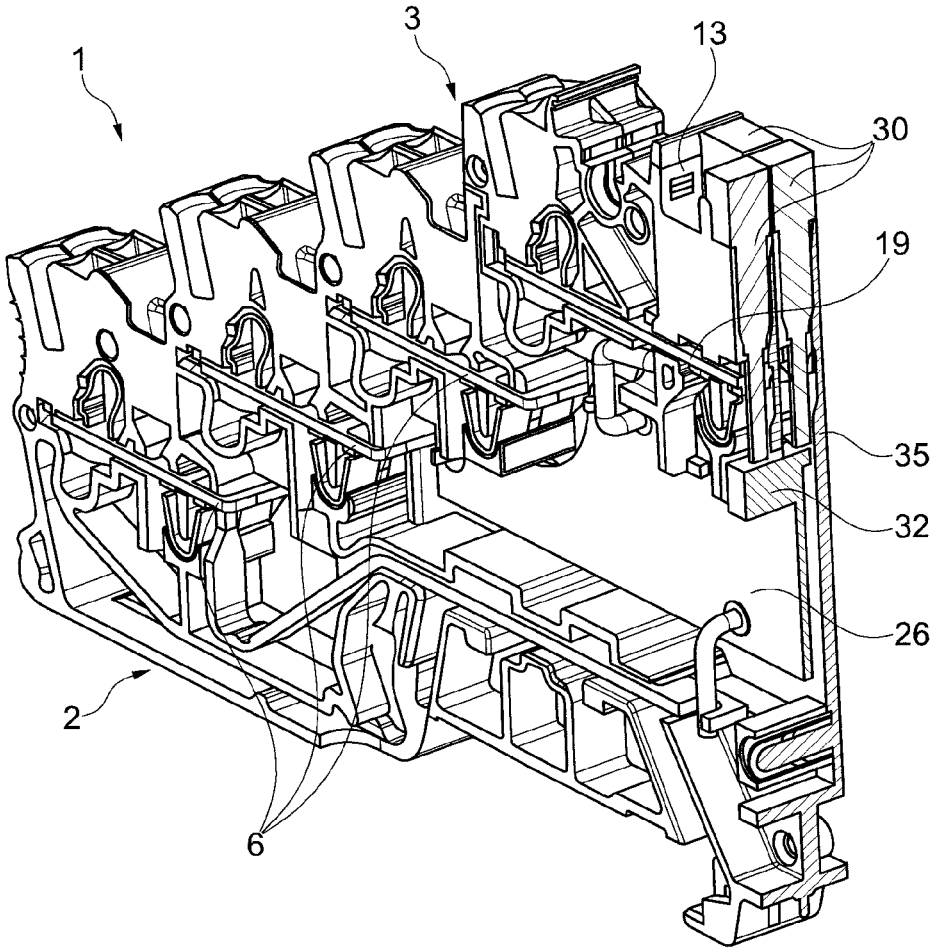
FIG. 8 shows a sectional view through the terminal strip from FIG. 7 in the region of the light guides.

FIG. 8 shows a sectional view through the terminal strip 1 from FIG. 6. In this case, it is clear that the rear side wall 35 of the base housing 2 is closed. The lower housing 3 is inserted into the cutout in the base housing 2 from that side which is situated opposite the rear side wall 35, that is to say from the open side, and is latched there. The light guides 30 are inserted into the bridge shafts 13 of the lower housing 3 and of the base housing 2 and lie against the light emission surface of a light 32 or adjoin said light emission surface through a small gap.

Figure 9:
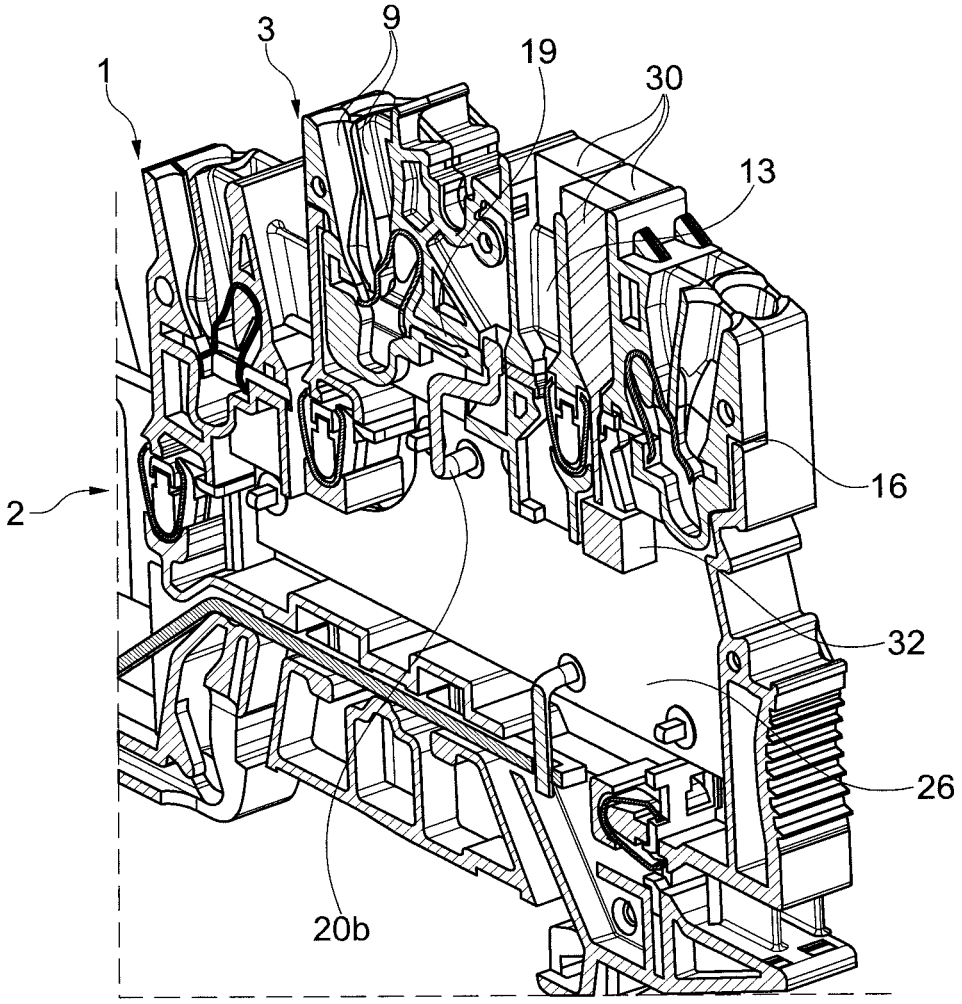
FIG. 9 shows a view of a longitudinal section through the terminal strip from FIG. 7.

FIG. 9 shows a view of a longitudinal section through a detail of the terminal strip 1 from FIG. 6. It is more clearly shown here that the base housing 2 has a cutout 16 which is accessible from the open side and into which the lower housing 3 is fitted. It can be seen here that an electrical conductor 20*b* is connected firstly to the printed circuit board 26 and secondly to the busbar 19 of the lower housing 3. In this case, the free end of the electrical conductor 20*b* enters an opening in the busbar 19 and is, for example, calked there.

Furthermore, it is clear that the bridge shafts 13 of the lower housing 3 and accordingly of the base housing 2 (not visible) lead as far as into the interior of the base housing 2 when the lower housing 3 is inserted into the cutout 16 in the base housing 2. Therefore, a light guide 30 can extend as far as into the interior of the base housing 2 and form an optically conducting connection with a light 32 which is fitted, for example, on a printed circuit board 26 of the base housing 2.

Figure 10:
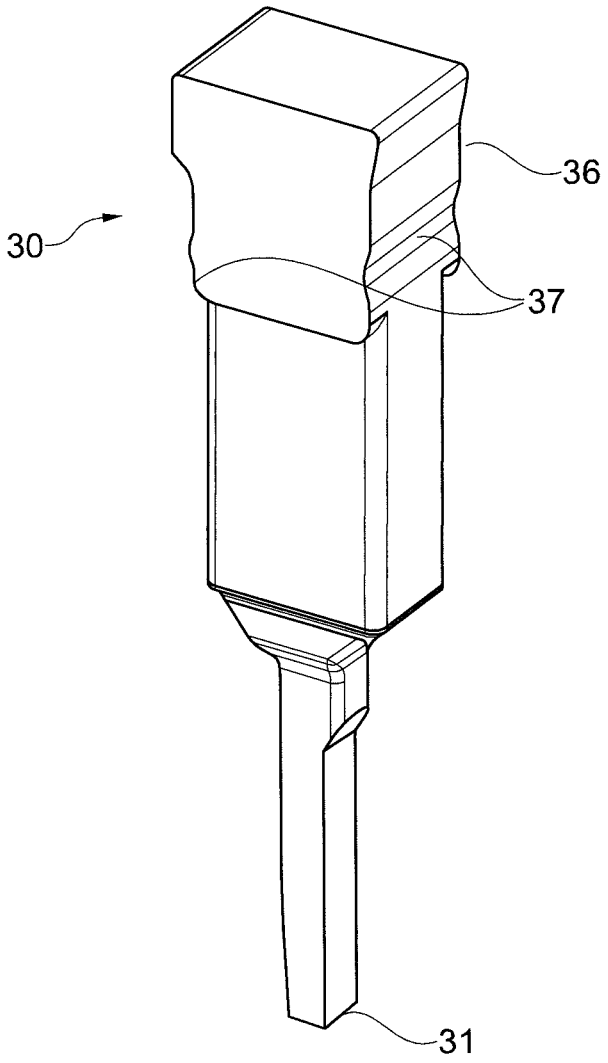
FIG. 10 shows a perspective view of a light guide for the terminal strip from FIG. 6.

FIG. 10 shows a perspective view of a light guide 30 of this kind. It is clear that the head region 36 of the light guide 30 has latching elements 37 in the form of latching recesses and opposite latching webs. These serve for latching the light guide 30 in a bridge shaft 13. The light guide 30 tapers in stages and ends in a light in a light inlet surface 31 which comes into optically conducting contact with a light 32.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A terminal strip comprising:

an insulating material housing, which has a latching foot for latching onto a mounting rail and has a width that is less than a length and a height; and conductor connections arranged in the insulating material housing that are arranged next to one another in pairs in a direction of the width, wherein the insulating material housing is formed in two parts and has a base housing and a lower housing, wherein the base housing has, in a first connection region, a pair of conductor connections that are electrically conductively connected to one another and that are arranged next to one another in the direction of the width and has, in a second connection region, a conductor connection and a cutout arranged next to one another in the direction of the width, wherein the cutout is laterally bounded by the insulating material of the second connection region, wherein the lower housing is adapted to be insertable into the cutout, and wherein, when the lower housing is inserted into the cutout, the lower housing has a conductor connection that is electrically insulated from the conductor connection that is arranged in the second connection region in the base housing, the conductor connection of the lower housing and the conductor connection that is arranged in the second connection region in the base housing being arranged next to one another in the direction of the width.

2. The terminal strip according to claim 1, wherein the first connection region has a plurality of pairs of conductor connections, and wherein the conductor connections, which are arranged next to one another, of the second connection region are connected to conductor connections of different conductor connection pairs, which are not electrically connected to one another, of the first connection region.

3. The terminal strip according to claim 1, wherein the lower housing is permanently installed in the cutout or can latch into the cutout as a separate lower housing.

4. The terminal strip according to claim 1, wherein the lower housing is a separate terminal strip comprising a busbar that has at least one conductor connection.

5. The terminal strip according to claim 4, wherein the lower housing has a bridge shaft that leads to a bridge opening in the busbar for receiving a transverse bridge or a light guide element.

6. The terminal strip according to claim 1, wherein conductor connections, which are electrically isolated from one another, of the first connection region are each connected to conductor connections, which are electrically insulated from one another and are arranged next to one another in the second connection region in the base housing and the lower housing via electrical conductors and/or via an electronics system that is accommodated in the insulating material housing.

7. The terminal strip according to claim 1, wherein pairs of conductor connections of the first connection region are arranged in potential levels that are situated one above the other in a direction of the height of the terminal strip and one behind the other in a direction of the length of the terminal strip.

8. The terminal strip according to claim 1, wherein the conductor connections of a conductor connection pair of the first connection region are arranged next to one another on a common busbar, and wherein the busbar has a connection point for terminal connection of an electrical conductor that is routed to a conductor connection of the second connection region or for connection of a printed circuit board that is accommodated in the base housing.

9. The terminal strip according to claim 8, wherein the busbar has a bridge opening for terminal connection of a transverse bridge, and wherein the base housing has a bridge shaft that leads to the bridge opening.

10. The terminal strip according to claim 1, wherein the conductor connections are spring-force clamping connections, screw-type clamping connections or insulation-displacement clamping connections.

11. The terminal strip according to claim 1, wherein the lower housing has a different color in relation to the base housing.

12. The terminal strip according to claim 1, wherein a side wall of the base housing that is arranged opposite the cutout is closed, and wherein the conductor connections are inserted into the base housing from a side which is provided with the cutout.

* * * * *